US006917333B2

(12) United States Patent
Ikegaya et al.

(10) Patent No.: US 6,917,333 B2
(45) **Date of Patent: *Jul. 12, 2005**

(54) FLAT-PLATE ANTENNA AND METHOD FOR MANUFACTURING THE SAME

(75) Inventors: Morihiko Ikegaya, Tokyo (JP); Takahiro Sugiyama, Tokyo (JP); Hisashi Tate, Tokyo (JP)

(73) Assignee: Hitachi Cable Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/280,097

(22) Filed: Oct. 25, 2002

(65) Prior Publication Data

US 2003/0090425 A1 May 15, 2003

(30) Foreign Application Priority Data

Nov. 9, 2001 (JP) ..... 2001-344882

(51) Int. Cl.[7] ..... H01Q 1/38; H01Q 1/24

(52) U.S. Cl. ..... 343/700 MS; 343/702; 343/872

(58) Field of Search ..... 343/700 MS, 707, 343/702, 872, 795, 767; H01Q 1/38, 1/24

(56) References Cited

U.S. PATENT DOCUMENTS

| | | | | | |
|---|---|---|---|---|---|
| 5,835,063 | A | * | 11/1998 | Brachat et al. | 343/700 MS |
| 6,344,823 | B1 | * | 2/2002 | Deng | 343/700 MS |
| 6,407,715 | B1 | * | 6/2002 | Chen | 343/767 |
| 6,478,229 | B1 | * | 11/2002 | Epstein | 235/492 |
| 6,600,448 | B2 | * | 7/2003 | Ikegaya et al. | 343/700 MS |
| 2002/0149529 | A1 | * | 10/2002 | Fleming et al. | 343/767 |
| 2003/0043083 | A1 | * | 3/2003 | Huang | 343/767 |
| 2003/0112202 | A1 | * | 6/2003 | Vogt | 343/873 |

FOREIGN PATENT DOCUMENTS

| | | | |
|---|---|---|---|
| EP | 0 749 176 A1 | 12/1996 | H01Q/9/04 |
| JP | 5-22018 A | 1/1993 | H01Q/9/06 |
| WO | WO 00/52784 A1 | 9/2000 | H01Q/9/04 |

* cited by examiner

*Primary Examiner*—Trinh Vo Dinh
(74) *Attorney, Agent, or Firm*—Foley & Lardner LLP

(57) ABSTRACT

A flat-plate antenna includes a conductive flat-plate, a slit portion formed through the conductive flat-plate with width proportional to frequency band width, a radiating element portion disposed one side of the slit portion, a ground portion disposed other side of the slit portion, and a power supply line having a first conductor connected to the radiating element and a second conductor connected to the ground portion.

6 Claims, 4 Drawing Sheets

FLAT-PLATE ANTENNA AND METHOD FOR MANUFACTURING THE SAME

BACKGROUND OF THE INVENTION

1. Field of the invention

The present invention relates to a flat-plate antenna for installation in an electrical apparatus such as a portable terminal or an electric appliance or on a wall or the like, and method for manufacturing the same, and more specifically, to flat-plate antenna and method for manufacturing the same for realizing thinner shape and excellent productivity, reducing labor for installation in an electrical apparatus or on a wall, and exhibiting desired antenna characteristics stably.

2. Prior Art

In recent years, except large-scale antennas for use in base station or satellite broadcasting, tendency to compactness of various kinds of antennas for use in a potable telephone or a mobile computer (hereinafter collectively referred to as "a portable terminal") have been progressing. Especially, accompanied with tendency to compactness of portable terminal itself, an antenna for use in a portable terminal is required to solve problems of installation space and request for satisfying characteristics contradicting to restriction of antenna volume. Moreover, in a plan of domestic wireless network which has been progressing recently, problem of an antenna size has been arisen, in accordance with installation of an antenna in a personal computer or an electric appliance (hereinafter collectively referred to as "an electric appliance") or on a wall surface within a room.

In FIG. 1(*a*) and FIG. 1(*b*), an example of a conventional small-size antenna is shown. This small-size antenna is a kind of inverted-F antenna, and is formed by connecting a chip antenna 50 on a ground portion 53 of a copper plate by solder reflowing. The chip antenna 50 having a radiating element portion 51*a,* 51*b,* a connecting portion 51*c* and a power supply portion (not shown in the figure) each of which are formed by covering a surface of a ceramic dielectric 52 with a cupper layer by photolithography,. The construction as described above leads to shorten length of a radiating element portion 51*a* of an antenna due to dielectric constant of a ceramic dielectric exceeding ten (10). Consequently, compact and lightweight antenna is realized.

However, according to a conventional small-size antenna, firstly, antenna efficiency is inferior due to large dielectric loss of a ceramic dielectric. Secondly, tendency to compactness and lightweight of a potable terminal such as a note-type personal computer or a potable telephone may be obstructed due to restriction of antenna thickness due to dependence of overall antenna thickness on a ceramic dielectric thickness. Thirdly, labor for connecting a power supply line is needed during installation work of an antenna in an electrical apparatus or on a wall. Fourthly, productivity of an antenna is inferior because process for forming a cupper layer on a radiating element potion and process for connecting a chip antenna on a cupper plate are separate. Fifthly, cost of an antenna increases due to inferior productivity of an antenna and expensiveness of a ceramic dielectric.

SUMMARY OF THE INVENTION

An object of the present invention is to provide a flat-plate antenna and method for manufacturing the same for realizing thinner shape and excellent productivity, reducing labor during installation in an electrical apparatus or on a wall, and stably exhibiting desired antenna characteristics.

In accordance with this invention, there is provided a flat-plate antenna comprising a conductive flat-plate, a slit portion formed through said conductive flat-plate with width proportional to frequency band width, a radiating element portion disposed one side of said slit portion, a ground portion disposed other side of said slit portion, and a power supply line having a first conductor connected to said radiating element and a second conductor connected to said ground portion. Since connection between a power supply cable and a conductive flat-plate is formed previously, labor for connecting a power supply line during installation work of an antenna is eliminated. If a power supply line is extended along a surface of said conductive flat-plate, thin shaped antenna could be obtained.

In accordance with further example of the present invention, there is provided a flat-plate antenna comprising a conductive flat-plate, a slit portion formed through said conductive flat-plate with width proportional to frequency band width, a radiating element portion disposed one side of said slit portion, a ground portion disposed other side of said slit portion, a power supply line having a first conductor connected to said radiating element and a second conductor connected to said ground portion, and a covering substrate covering at least said conductive flat-plate. Since a conductive flat-plate is reinforced with a covering substrate, deformation of a conductive flat-plate is prevented.

In accordance with this invention, there is provided a method for manufacturing a flat-plate antenna comprising a step of forming a conductive flat-plate having a slit portion with width proportional to frequency band width, a radiating element portion disposed one side of said slit portion, and a ground portion disposed other side of said slit portion, wherein said slit portion is formed by press punching through said conductive flat-plate, and a step of connecting a first conductor of a power supply line with a part of said radiating element portion and a second conductor with a part of said ground portion. If slits are preferably formed by press punching on plural portions along length direction of a lead-frame, a plurality of conductive flat-plates could be obtained at once from a piece of lead-frame.

In accordance with further example of this invention, there is provided a method for manufacturing a flat-plate antenna comprising a step of forming a conductive flat-plate having a slit portion with width proportional to frequency band width, a radiating element portion disposed one side of said slit portion, and a ground portion disposed other side of said slit portion, wherein said slit portion is formed by press punching through a lead-frame, a step of laminating over said lead-frame with a resinous film, a step of forming a first and second connecting hole through which a part of said lead-frame of said radiating element portion is exposed, a step of press punching said laminated lead-frame including said slit portion, said radiating element portion and said ground portion, and a step of connecting a first conductor of a power supply line with a part of said radiating element portion exposed through said first connecting hole and a second conductor of a power supply line with a part of said ground portion exposed through said second connecting hole. Since a conductive flat-plate is reinforced with resinous film, deformation of a conductive flat-plate which is formed by press punching a lead-frame including a slit portion, a radiating element portion and a ground portion is prevented.

BRIEF DESCRIPTIION OF THE DRAWINGS

FIG. 1(*b*) shows a side view of a conventional small-size antenna.

FIG. 2 (*b*) show a sectional view taken along line A—A of FIG. 2(*a*).

FIG. 2(*c*) show a sectional view taken along line B—B of FIG. 2(*a*).

FIG. 4(*a*), FIG. 4(*b*), FIG. 4(*c*) and FIG. 4(*d*) show a manufacturing step of flat-plate antenna according to an example of the present invention.

DESCRIPTION OF THE PREFERRED EMBODIMENTS

Figure 1A:
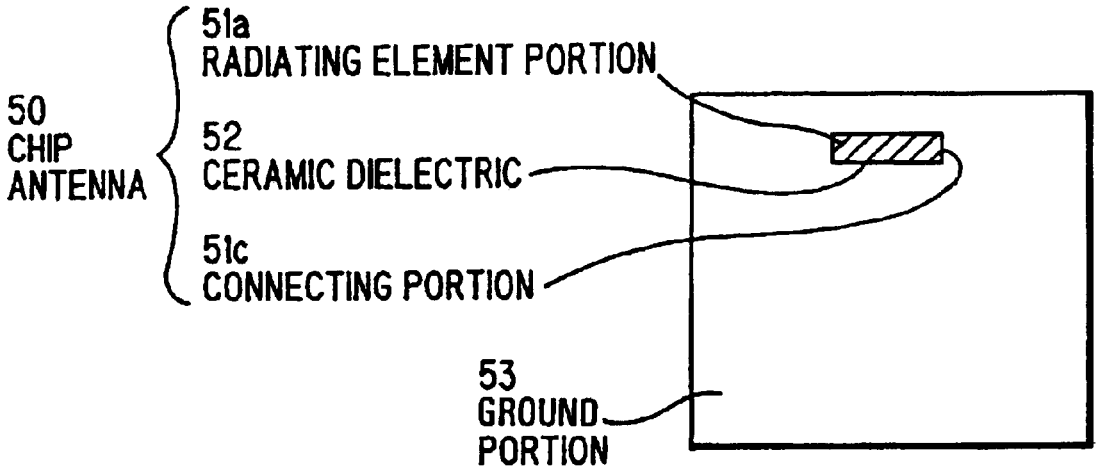
FIG. 1A PRIOR ART
FIG. 1(*a*) shows a plane view of a conventional small-size antenna.
Figure 1B:
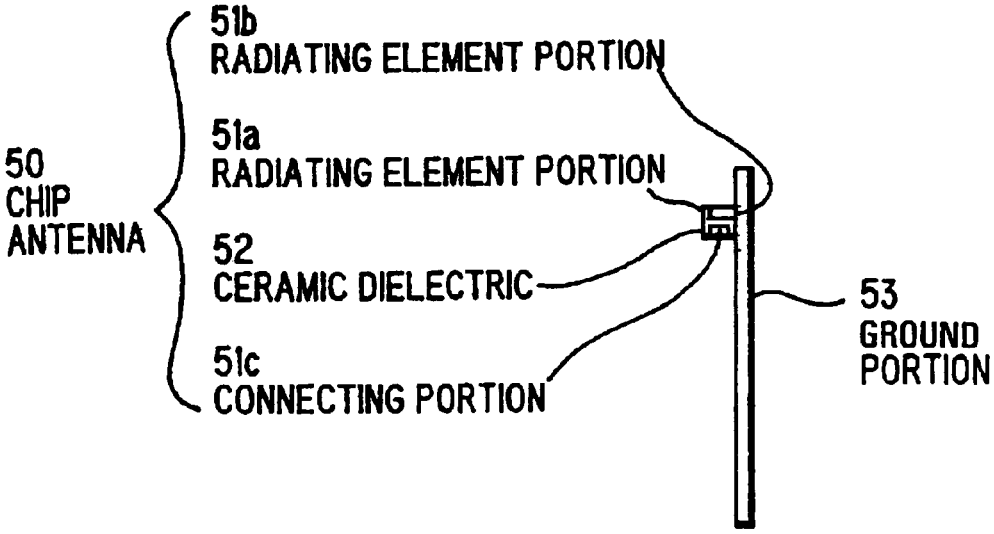
FIG. 1B PRIOR ART
Figure 2A:
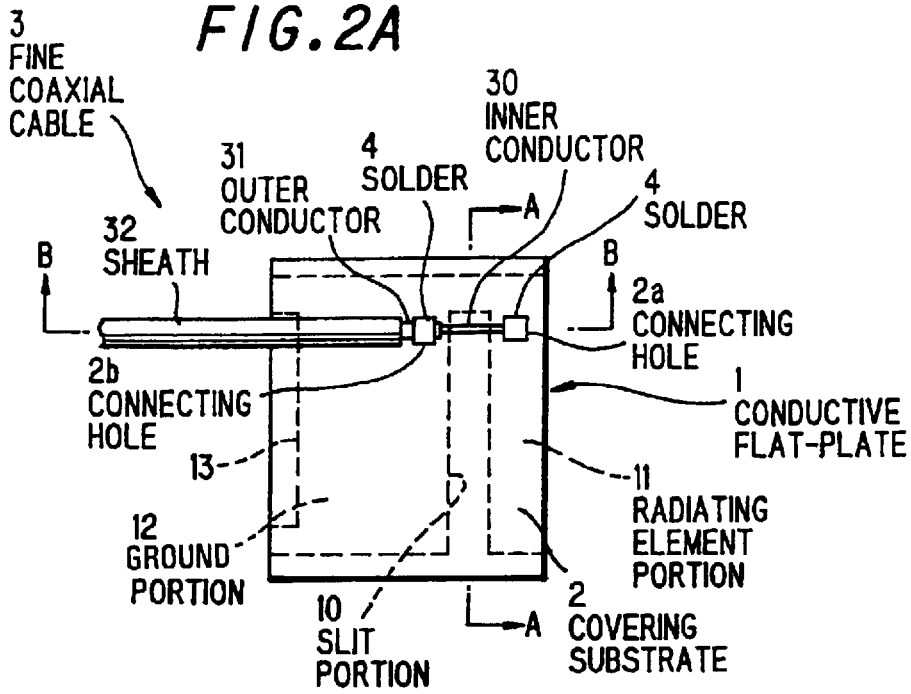
FIG. 2(*a*) shows a plane view of a flat-plate antenna according to an example of the present invention.
Figure 2B:
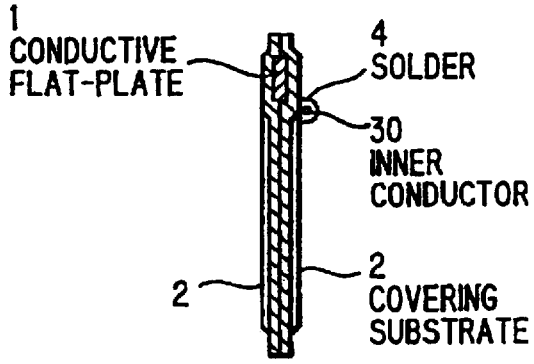
Figure 2C:
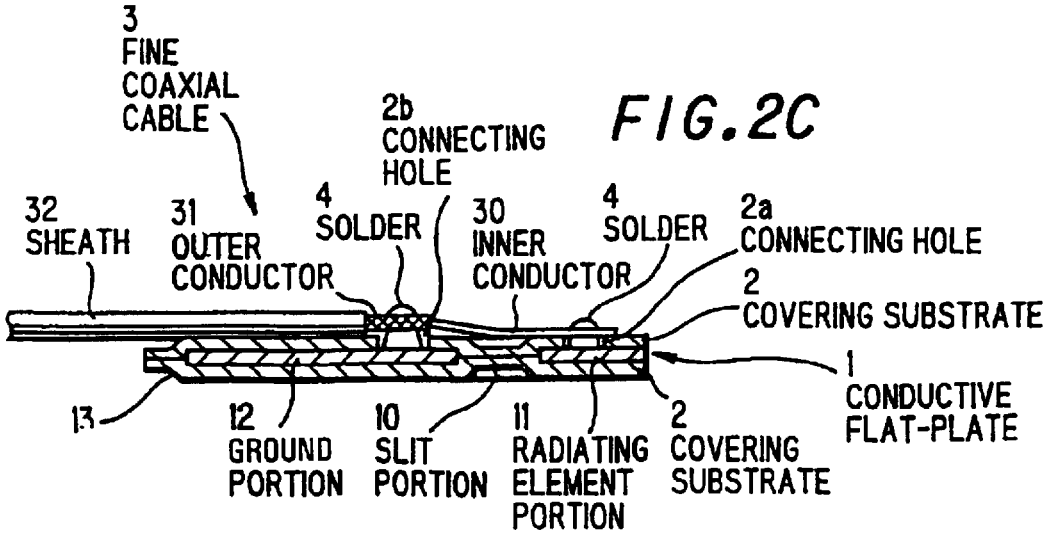

A flat-plate antenna according to an example of the present invention is shown in FIG. 2(*a*)–FIG. 2(*c*). A flat-plate antenna comprises a slit portion 10 having width proportional to frequency band width, a conductive flat-plate 1 having a L shaped radiating element portion 11 disposed on one side of said slit portion 10 and a ground portion 12 disposed on other side of said slit portion 10, a covering substrate 2 covering said conductive flat-plate 1 with a resinous film and a fine coaxial cable 3 supplying power to said conductive flat-plate 1.

A covering substrate 2 is preferably formed by laminating over a surface of conductive flat-plate 1 with a resinous film. A heat resistant film such as a polyester film is preferably used as a resinous film to reinforce a conductive flat-plate 1 and to prevent deformation of it. Moreover, melting or deformation of a conductive flat-plate 1 caused by heat of solder connecting of a fine coaxial cable 3, or heat from surrounding operating apparatus can be prevented. Especially, a polyester film keeps the conductive flat-plate 1 clean for a long term by preventing defect, breakage, dirt or etc. due to its excellent heat resistant, water resistant and wear resistant. Other heat resistant films such as a polyimide film, a polyamide film or a polyphenylene-sulphide film are applicable in the present invention.

A fine coaxial cable 3 is comprising an inner conductor 30 formed by a single wire or a stranded wire having a plurality of wires, an outer conductor 31 formed on an inner conductor 30 through insulating layer, and a sheath 32 covering an outer conductor 31. Length of a fine coaxial cable 3 depends on a kind of applying electric apparatus or wall. For example, a length of a fine coaxial cable is 400 mm for use in notebook-type personal computer. If a flat-plate antenna is installed on a display, a wiring to communication module disposed back of keyboard through hinge portion is made by use of a fine coaxial cable. Electrical connections between an inner conductor 30 of a fine coaxial cable 3 and a radiating element portion 11, and between an outer conductor 31 and a ground portion 12 are made by solder 4 at a portion where impedance matching is achieved. Electrical connection may be achieved by conductive adhesives, connectors or etc. A flat cable formed by arranging a first conductor connected to the radiating element portion 11 and a second conductor connected to the ground portion 12 on a same plane may be used as a power supply line instead of a fine coaxial cable 3. By using such a flat cable, a thinner flat-plate antenna can be obtained.

Figure 3:
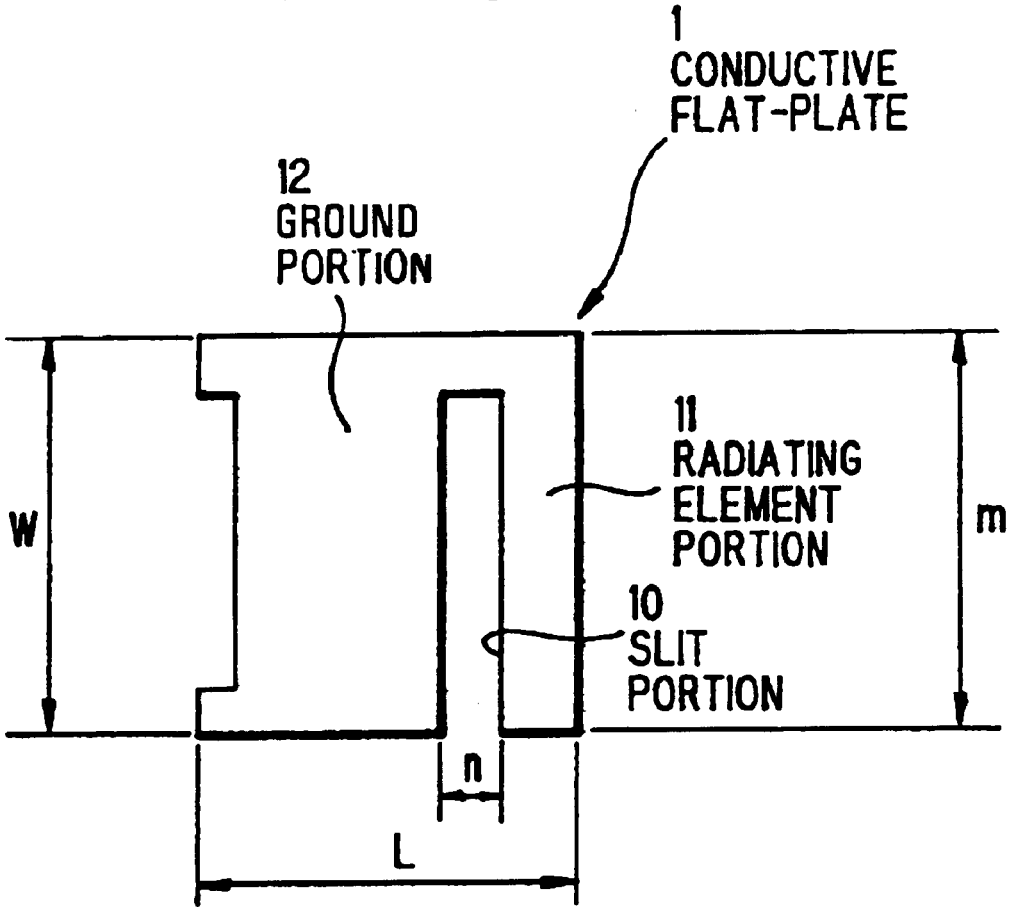
FIG. 3 shows a plane view of a conductive flat-plate according to an example of the present invention.
Figure 4A:
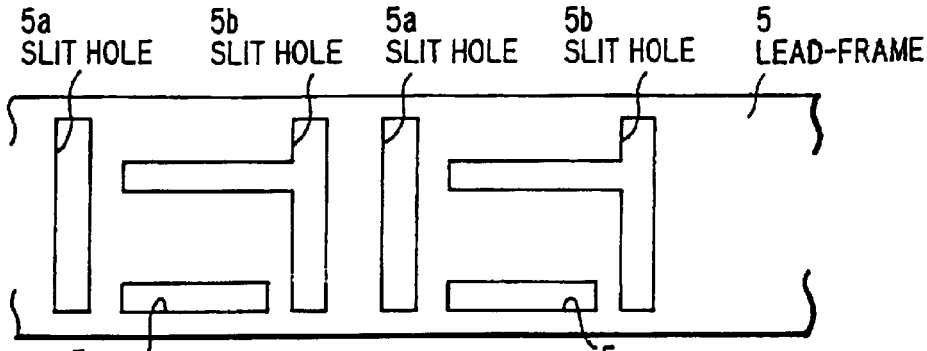
Figure 4B:
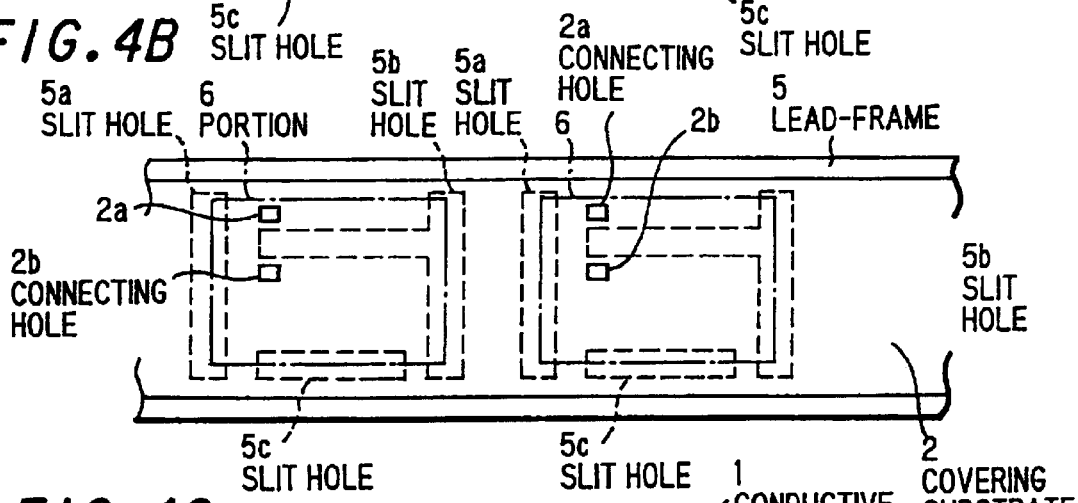
Figure 4C:
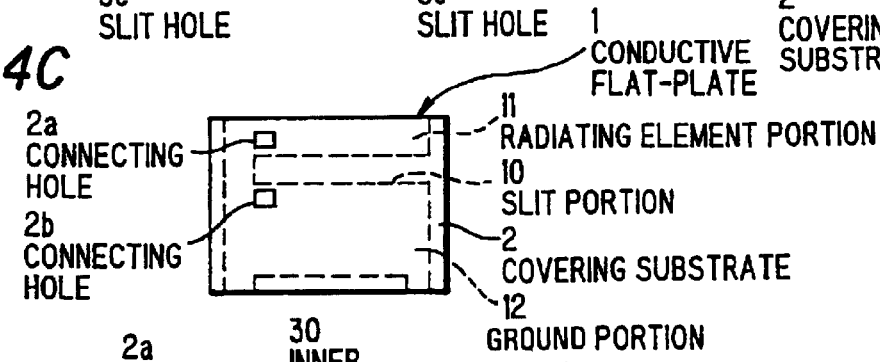
Figure 4D:
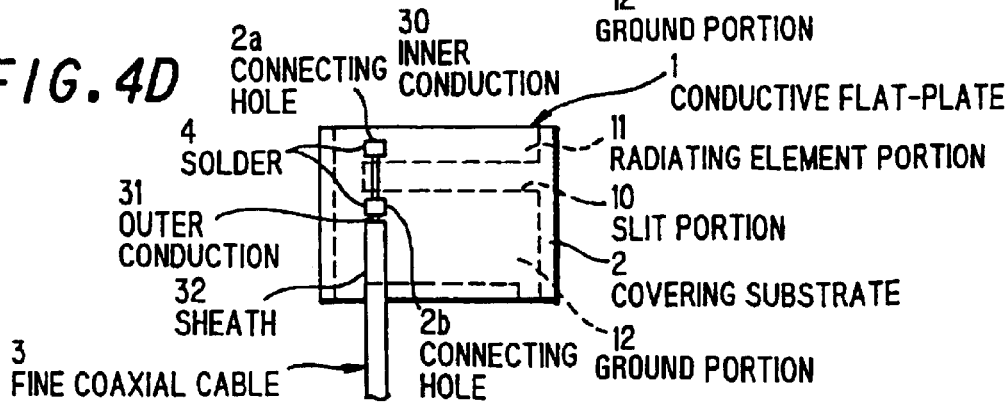

A conductive flat-plate 1 according to an example of the present invention is shown in FIG. 3. In general, length m of a radiating element portion 11 of a flat-plate antenna 1 is selected to be $\lambda$, $\lambda/2$, $\lambda/4$, $\lambda/8$ or the like, wherein $\lambda$ is a wave length of operating frequency. The shorter a length m, the more compact flat-plate antenna is obtained. However, if length m is too short, a flat-plate antenna with low sensitivity or narrow frequency band might be obtained. Considering the foregoing, length m of a radiating element portion 11 is selected to be $\lambda/4$ in this example. For example, if operating frequency is 2.4 GHz, length m of a radiating element portion 11 is about 30 mm. If a flat-plate antenna is installed in a housing of an electric appliance, operating frequency is determined by installing position, and if a flat-plate antenna is installed on a wall, operating frequency is determined by installing circumstance. Size of each portion of a conductor flat-plate 1 such as width and length of a slit portion 10 or width and length of a radiating portion 11 is determined by desired antenna characteristics. Length m of a radiating element portion 11 contributes to resonant frequency, width n of the slit portion 10 contributes to frequency band, and ratio L/W between length L of a conductor flat-plate 1 and width W of a ground portion 12 contributes to directivity.

A process for manufacturing a flat-plate antenna according to an example of the present invention is shown in FIG. 4(*a*)–FIG. 4(*d*). Slit holes 5*a,* 5*b* and 5*c* having 2 mm width are formed together by press punching on plural portions along length direction of a lead-frame 5. The lead-frame is made of phosphor bronze and having 0.2 mm thickness and 40 mm width. As shown in FIG. 4(*b*), a lead-frame 5 is exposed through connecting holes 2*a,* 2*a*. These connecting holes 2*a,* 2*b* are formed by etching a part of surface of a polyester film after laminating over both surfaces of lead-frame 5 with polyester film. A substance as shown in FIG. 4(*c*) is obtained by press punching a portion 6 as shown dotted line of FIG. 4(*b*). As shown in FIG. 4(*d*), an inner conductor 30 of a fine coaxial cable 3 is connected by solder 4 to a radiating element portion 11 which is exposed through connecting hole 2*a,* and a outer conductor 31 of a fine coaxial cable 3 is connected by solder 4 to a ground portion 12 which is exposed through connecting hole 2*b*.

According to an example explained above, the following effects are performed.

(a) Since a conductive flat-plate is laminated with a heat resistant resinous film such as polyester film and a fine coaxial cable is extended along a surface of a conductive flat-plate, when a conductive flat-plate having 0.2 mm thickness, a fine coaxial cable having 0.8 mm diameter, and a resinous film having 0.1 mm thickness are used, a thin-type flat-plate antenna having 1.2 mm overall thickness can be obtained. Consequently, thin-type antenna become to be installed in a narrow space of a housing, installment in an electrical apparatus or on a wall easily established.

(b) Since deformation of a conductive flat-plate is prevented by laminating a conductive flat-plate with a resinous film, when a flat-plate antenna is installed in an electrical apparatus, desired antenna characteristic can be exhibited stably. Referring to FIG. 3, by determining length m of a radiating element portion 11 as 30 mm, resonant frequency 2.4 GHz matched with operating frequency is obtained, further, by determining width n of a slit portion 10 as 2 mm, frequency bandwidth more than 200 MHz is obtained, further more, by determining both length L of a conductive flat-plate and width W of a ground portion as 30 mm, non-directivity is obtained.

(c) Since a fine coaxial cable is previously connected to a conductive flat-plate, labor for connecting a fine coaxial cable is eliminated during installation work of a flat-plate antenna in an electric apparatus or on a wall. Further, by using a fine coaxial cable as a power supply line, wiring of a fine coaxial cable within an electrical apparatus is fulfilled freely without obstructing to other parts arranged in said electrical apparatus.

(d) Since a plurality of conductive flat-plates are obtained at once from a piece of lead-frame, productivity and cost are improved.

As described in detail above, according to the present invention, labor for connecting a power supply line during installation work of an antenna is eliminated by connecting between a power supply cable and a conductive flat-plate previously.

Further, thin shaped antenna can be obtained by extending a power supply line along a surface of a conductive flat-plate.

Further, desired antenna characteristic can be exhibited stably, because deformation of a conductive flat-plate is prevented by reinforcement of a conductive flat-plate with resinous film.

Further, obtaining a plurality of conductive flat-plates at once from a piece of lead-frame and improving productivity of a flat-plate antenna become possible by using a lead-frame as a conductive flat-plate and by press punching on plural portions along length direction of a lead-frame.

What is claimed is:

1. A flat-plate antenna comprising:

a conductive flat plate having a slit portion with a width proportional to a frequency band width, a radiating element portion disposed on one side of said slit portion, and a ground portion disposed on the other side of said slit portion, the ground portion having a width sufficiently greater than that of the radiating element portion; and a power supply line having a first conductor directly connected to said radiating element portion and a second conductor directly connected to said ground portion.

2. The flat-plate antenna according to claim 1, wherein:

the first conductor is directly connected through solder to said radiating element portion and the second conductor is directly connected through solder to said ground portion.

3. The flat-plate antenna according to claim 1, wherein:

said power supply line is extended along a surface of said conductive flat plate.

4. The flat-plate antenna according to claim 1, wherein:

said power supply line is a coaxial cable having an inner conductor and an outer conductor, said inner conductor serves as said first conductor and said outer conductor serves as said second conductor.

5. The flat-plate antenna according to claim 1, wherein:

said power supply line is a flat cable formed by arranging said first conductor and said second conductor on a same plane.

6. A flat-plate antenna comprising:

a conductive flat plate having a slit portion with a width proportional to a frequency band, a radiating element portion disposed on one side of said slit portion, and a ground portion disposed on the other side of said slit portion;

a power supply line having a first conductor directly connected to said radiating element portion and a second conductor directly connected to said ground portion; and a covering substrate covering at least said conductive flat plate, wherein said covering substrate includes a first opening for allowing the first conductor to be solder-coupled directly to said radiating element portion, and wherein said covering substrate includes a second opening for allowing the second conductor to be solder-coupled directly to said ground portion.

* * * * *